US005241871A

United States Patent [19]

McKnight, III et al.

[11] Patent Number: 5,241,871

[45] Date of Patent: Sep. 7, 1993

[54] TORQUE LIMITING STARTER DRIVE CLUTCH ASSEMBLY

[75] Inventors: Early C. McKnight, III; Bobby E. McMillen, both of Columbus, Miss.

[73] Assignee: United Technologies Motor Systems, Inc., Dearborn, Mich.

[21] Appl. No.: 965,500

[22] Filed: Oct. 23, 1992

[51] Int. Cl.[5] ..... F02N 15/06

[52] U.S. Cl. ..... 74/7 C; 192/42; 192/55; 192/103 C; 464/46; 74/7 R

[58] Field of Search ..... 74/7 R, 7 C; 192/42, 192/55, 949, 7, 103 C; 464/30, 45, 46

[56] References Cited

U.S. PATENT DOCUMENTS

| | | | |
|---|---|---|---|
| 3,690,188 | 9/1972 | McMillen | 74/7 R |
| 3,791,685 | 2/1974 | Hamman | 290/38 |
| 4,192,195 | 3/1980 | Kazino et al. | 464/30 X |
| 4,255,982 | 3/1981 | Kern | 74/7 R |
| 4,330,713 | 5/1982 | Greenwood | 74/7 R X |
| 4,369,666 | 1/1983 | Kern | 74/7 R |
| 4,479,394 | 10/1984 | Greenwood | 74/7 R |
| 4,524,629 | 6/1985 | Digby | 74/7 R |

*Primary Examiner*—Allan D. Herrmann
*Assistant Examiner*—William O. Trousdell
*Attorney, Agent, or Firm*—Ronald G. Cummings

[57] ABSTRACT

An electric starter having an electric motor with a rotatable shaft, a pinion gear for driving a flywheel, and a friction clutch for transmitting torque which includes a drive plate connected to the shaft and a friction coupling for frictionally transmitting torque between the drive plate and pinion gear wherein the coupling is compressible and a stop limits compression to a predetermined maximum compression so as to set a predetermined slip torque or limit torque transfer to a predetermined maximum torque.

22 Claims, 1 Drawing Sheet

TORQUE LIMITING STARTER DRIVE CLUTCH ASSEMBLY

TECHNICAL FIELD

The present invention relates to a clutch assembly and method for limiting torque transmission and having particular utility in an electric starter for an internal combustion engine.

BACKGROUND AND SUMMARY OF THE INVENTION

Electric starter motors are widely utilized for cranking small gasoline engines such as those utilized in garden tractors, lawn mowers, snow blowers, outboard motors for boats, etc. In such a starter, a pinion drive provides the means for momentarily engaging the engine flywheel in transferring power from the electric starting motor to the internal combustion engine and then disengaging the starter motor from the flywheel once the engine has started to prevent damage to the starter motor. The most common way to facilitate engagement and disengagement of the pinion to the flywheel is to mount the pinion gear to a shaft so that it is rotatably driven by the motor and is axially movable along the shaft. The axial movement allows full engagement of the pinion gear with the flywheel during cranking and complete disengagement once the engine has started. The axial travel of the pinion gear is generally facilitated by one of two means. The pinion gear is either forced along the shaft by a solenoid or by inertia of the pinion gear interacting with the accelerating motor shaft by means of mating helical threads on the pinion gear and on the shaft. Exemplary starter assemblies are disclosed in Kern, U.S. Pat. No. 4,255,982 and McMillan, U.S. Pat. No. 3,690,188 which are incorporated herein by reference. In a typical configuration, the flywheel of an internal combustion engine has gear teeth at its outer periphery and is juxtaposed with a spring biased pinion gear coupled to the output shaft of a starting motor through a torque-limiting friction clutch and a helical spline. When the starting motor is activated and begins to rotate, the inertia of the pinion gear resists rotation and the helical spline causes the pinion gear to translate axially along the starting motor shaft and into engagement with the gear teeth on the flywheel. The engine is thus cranked until the engine speed passes the speed at which it is driven by the starter motor whereupon the helical spline causes the pinion gear to disengage from the flywheel gear teeth. An anti-drift spring operates to urge the pinion gear toward the disengaged position.

As can be appreciated, the starter is subjected to shock and loading stresses as it engages and disengages the engine flywheel. Such stresses are inherent as the motor armature and pinion are rotating as the pinion gear engages the large mass of the flywheel and engine components which are at rest.

Under certain conditions, the engine direction of revolution may suddenly reverse (referred to as "back drive") and, if the operator is re-energizing the starter at that time, the resulting shock is greatly increased and can damage the starter motor, pinion gear and/or flywheel gear. For example, when the starter is engaged and rotating the engine, the engine may fire once and accelerate the flywheel which disengages the pinion. As the engine piston next comes up on the compression stroke, there may not be enough momentum to carry the piston over top dead center and consequently, as the cylinder fires before top dead center, the flywheel reverses. It is also possible that as the piston comes up on the compression stroke, it may not even reach the point where firing occurs, but rather stops under compression. The compressed air in the cylinder will drive the piston back down, thus reversing the direction of the flywheel rotation. If the operator actuates the starter switch as the flywheel is back driven, the pinion which is turning in one direction will engage the back driven flywheel turning in the opposite direction, thus subjecting the starter to great impact and shock that often results in damage to the starter.

In such circumstances, it is desirable to allow slippage in the clutch at a predetermined torque value (referred to as "slip torque") so as not to suddenly reverse drive the armature of the motor and damage the starter.

Accordingly, it is an object of the present invention to provide a friction clutch assembly which limits torque transfer to a predetermined maximum torque value.

Another object of the invention is to provide an electric starter with a clutch assembly having a predetermined slip torque to prevent damage to the starter from engine back drive.

A further object of the invention is to provide such a clutch assembly which utilizes a minimum of components which are economical to manufacture and cost efficient to assemble.

A still further object of the invention is to provide a new and improved method for setting the slip torque of a friction clutch to a predetermined value.

Other objects will be in part obvious and in part pointed out more in detail hereinafter.

It has been found that the foregoing and related objectives are attained in an electric starter having an electric motor with a rotatable shaft, a pinion gear for driving a flywheel and a clutch assembly for transmitting torque between the shaft and pinion gear wherein the clutch assembly includes a driving member connected to the shaft for rotational movement and a coupling for frictionally transmitting torque between the driving member and the pinion gear. The coupling has a longitudinal axis and is compressible longitudinally by engagement with the driving member. The clutch assembly and the pinion gear are configured to allow a predetermined maximum compression of the coupling during torque transmission so as to set a predetermined coupling slip torque. In one embodiment, a stop is utilized for engaging the driving member to limit compression of the coupling to the predetermined maximum compression so as to thereby set a predetermined coupling slip torque.

In the method of the present invention, the slip torque of the coupling is determined by limiting the compression of the friction coupling to a predetermined maximum compression which provides the desired slip torque.

DESCRIPTION OF THE PREFERRED EMBODIMENT

Figures 1, 2, 3, 4:
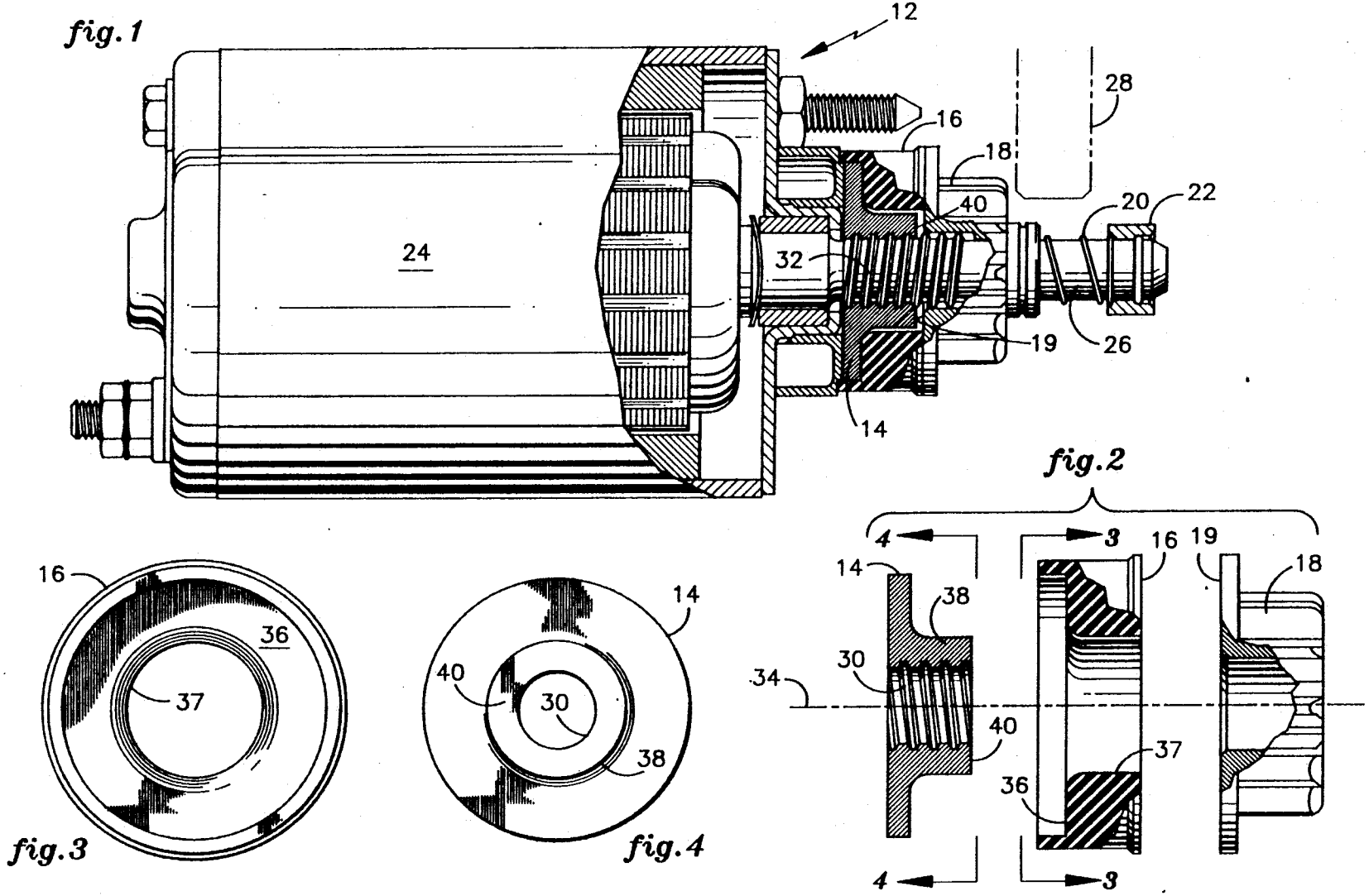
FIG. 1 is a front view, partly broken away and partly in section, of the engine starter assembly of the present invention.
FIG. 2 is an exploded view, partly broken away and partly in section, of the pinion and clutch assembly of the present invention.
FIG. 3 is an end view seen on line 3—3 of FIG. 2.
FIG. 4 is an end view seen on line 4—4 of FIG. 2.

Although specific forms of the present invention have been selected for illustration in the drawings, and the following description is drawn in specific terms for the purpose of describing these forms of the invention, the description is not intended to limit the scope of the invention which is defined in the appended claims.

Referring to FIG. 1, the engine starter of the present invention generally comprises a starter motor 12, drive plate 14, friction coupling 16, pinion gear 18, anti-drift spring 20 and retainer 22.

The motor 12 is a conventional 12 volt DC starter motor having a housing 24 and an armature shaft 26 extending therefrom. The metal pinion gear 18 is journaled on the shaft 26 for rotational movement and for axial displacement along the shaft to engage and disengage flywheel 28.

The annular metal drive plate 14 has an axial through bore with an internal helical thread 30 that mates with the external helical thread 32 of the shaft 26. The drive plate 14 is connected to the shaft 26 by the mating threads 30,32 so that any relative movement between the drive plate and the shaft 26 will cause the drive plate to move axially along the shaft.

The coupling 16 is a friction-type coupling for transferring torque by friction between the coupling and the drive plate and/or the pinion gear. The annular shaped coupling 16 is concentrically mounted on the shaft 26 and interposed between the drive plate 14 and the end face 19 of pinion gear 18. The coupling may be bonded to the pinion gear so that the frictional drive connection is between the drive plate and the coupling. The coupling may be bonded to the drive plate so that the frictional drive connection is between the pinion gear and the coupling. The coupling may also be unbonded.

The coupling 16 is formed of elastomer material such as neoprene rubber so as to be compressible along the longitudinal axis 34. Other forms of compressible couplings may also be acceptable. The coupling 16 has a recess or through bore 36 formed to receive the drive plate 14 as seen in FIGS. 1 and 2. With the coupling 16 bonded to the pinion 18, torque is transferred through the frictional engagement of the drive plate 14 with the interior surface of recess 36. As the coupling 16 compresses under the force of drive plate 14, friction increases between the drive plate and the coupling which reduces and ultimately prevents slippage between the drive plate and coupling as the load increases. The friction force is related to the amount of compression of the coupling and therefore, the maximum torque transferred (or the slip torque) can be set by controlling the amount of compression of the coupling 16.

In the illustrated embodiment, the drive plate 14 has a hub or annular boss 38 terminating in an annular end face forming an abutment surface 40. The boss 38 is dimensioned and configured to extend through the counter-recess portion 37 of recess 36 so that abutment surface 40 engages end plate 19 to form a stop and thereby limit the compression of coupling 16 to a predetermined amount. The amount of compression is predetermined to provide a desired slip torque to protect the starter against damage in the event of back drive. (If the drive plate and pinion are formed from powdered metal, it may be desirable to interpose two metal slip washers between the abutment surfaces to protect the powdered metal surfaces and assure consistent operation.) Alternately, a projecting abutment surface may be formed on the end face 19 of pinion 18. While the stop of the illustrated embodiment is formed by mating abutment surfaces on the drive plate and the pinion gear, an acceptable stop may be formed on other portions of the motor. Moreover, other types of limiting means may be utilized to limit the amount of compression of the coupling under the axial force of the drive plate.

In the initial at-rest position shown in FIG. 1, the drive plate 14 is nested within the recess 36 of coupling 16. Sufficient space is provided between the boss 38 and the coupling 16 to allow for displacement of the coupling material during longitudinal compression of the coupling. As can be seen, the abutment surface 40 is spaced from the abutment surface 19 of the pinion gear 18. Upon energization of the starter motor, the shaft 26 will accelerate while the inertia of the pinion gear, the coupling and the drive plate will cause them to want to remain at rest. The drive plate will move to the right (as viewed in FIG. 1) by the interaction of the threads 30,32 of the drive plate and shaft, respectively. As the pinion engages the flywheel 28 which will then develop a load on the pinion, the drive plate 14 will begin to compress the coupling 16. As the coupling compresses, friction increases between the drive plate and the coupling which reduces and ultimately prevents slippage between the two components as the load increases. The amount that the drive plate can compress the coupling is determined by the travel of the drive plate before the boss 38 bottoms against the end face 19 of pinion 18. When bottoming occurs, maximum friction will exist and torque loading above this amount will cause the clutch to slip. Thus, the clutch is preset by design to provide adequate torque without slipping so as to turn the engine. If back drive conditions occur, the maximum preset friction will allow slippage, thus preventing damage to the starter, the pinion drive and the engine flywheel. Accordingly, by controlling the degree of compression of the coupling 16, the maximum torque (or slip torque) may be set.

While the present invention has been described in the context of an electric starter where it is desirable to achieve a predetermined slip torque to prevent damage in the event of back drive, it should be appreciated that the clutch assembly described may be utilized in other applications where it is desirable to limit torque transfer to a predetermined maximum amount.

As can be seen, an electric starter has been described which provides a predetermined slip torque to prevent damage from engine back drive. Further, the friction clutch assembly of the present invention limits torque transfer to a predetermined maximum torque and utilizes a minimum of components which are economical to manufacture and cost efficient to assemble. Accordingly, the present invention achieves all of the stated objectives.

As will be apparent to persons skilled in the art, various modifications and adaptations of the structure above described will become readily apparent without departure from the spirit and scope of the invention, the scope of which is defined in the appended claims.

What is claimed is:

1. An electric starter for an internal combustion engine comprising:

an electric motor having a rotatable shaft, a pinion gear mounted for driving a flywheel of an engine, and a clutch assembly for transmitting torque between the shaft and the pinion gear, said clutch assembly comprising a driving member connected to said shaft for rotational movement, and a coupling for frictionally transmitting torque between the driving member and the pinion gear, said coupling having a longitudinal axis and being compressible longitudinally, said clutch assembly and said pinion gear being configured to allow a predetermined maximum compression of said coupling during torque transmission so as to set a predetermined coupling slip torque.

2. The device of claim 1 comprising a stop configured and positioned to limit compression of said coupling during torque transmission to said predetermined maximum compression.

3. The device of claim 1 comprising stop means for limiting compression of said coupling by said driving member to said predetermined maximum compression, said driving member being mounted for movement along said shaft to compress said coupling.

4. The device of claim 3 wherein said coupling is disposed between said driving member and said pinion gear and said stop means comprises said driving member and said pinion gear having mating abutment surfaces configured to limit displacement of said driving member toward said pinion gear to limit compression of said coupling to said predetermined maximum compression.

5. The device of claim 4 wherein said driving member has a boss with a terminal end forming said abutment surface of said driving member and said pinion gear has an end face portion forming said abutment surface of said pinion gear, said boss and said end face portion of pinion gear being relatively configured and disposed so that said terminal end of said boss abuts said end face portion of said pinion gear at said predetermined maximum compression of said coupling.

6. The device of claim 1 wherein said coupling is formed of elastomer material and is bonded to said pinion gear.

7. The device of claim 1 wherein said coupling is formed of elastomer material and is bonded to said driving element.

8. The device of claim 1 wherein said coupling is formed of elastomer material and is disposed between said driving element and pinion gear.

9. The device of claim 8 wherein said coupling is annular shaped and mounted concentric to said pinion gear and said driving element.

10. The device of claim 1 wherein said pinion gear is mounted about said shaft for axial displacement along said shaft to engage and disengage a flywheel, said driving member is mounted about said shaft for rotational and axial movement to engage said coupling and drive said pinion gear, said driving member having an axially extending boss, said coupling is disposed between said driving member and said pinion and has an axial through bore configured to receive said boss of said driving member, and said boss being configured to abut said pinion gear to limit compression of said coupling at said predetermined maximum compression.

11. A friction clutch subassembly for limiting torque transfer to a predetermined maximum torque comprising a driving member, a driven member, and a coupling for frictionally transmitting torque between the driving member and the driven member, said coupling having a longitudinal axis and being compressible longitudinally, said driving member, said driven member and said coupling being configured for a predetermined maximum compression of said coupling during torque transmission so as to limit torque transfer to a predetermined maximum torque.

12. The device of claim 11 comprising a stop configured and positioned to limit compression of said coupling during torque transmission to said predetermined maximum compression.

13. The device of claim 11 wherein said driving member is adapted for movement to compress said coupling and said friction clutch subassembly further comprises stop means for limiting compression of said coupling by said driving member to said predetermined maximum compression.

14. The device of claim 13 wherein said coupling is disposed between said driving member and said driven member and said stop means comprises said driving member and said driven member having mating abutment surfaces configured to limit displacement of said driving member toward said driven member to limit compression of said coupling to said predetermined maximum compression.

15. The device of claim 14 wherein said driving member has a boss with a terminal end forming said abutment surface of said driving member and said driven member has an end face forming said abutment surface of said driven member, said boss and said end face being relatively configured and disposed so that said terminal end of said boss abuts said end face of said driven member at said predetermined maximum compression of said coupling.

16. The device of claim 11 wherein said coupling is formed of elastomer material and is bonded to said driven member.

17. The device of claim 11 wherein said coupling is formed of elastomer material and is bonded to said driving member.

18. The device of claim 11 wherein said coupling is formed of elastomer material and is disposed between said driving element and driven member.

19. The device of claim 18 wherein said coupling is annular shaped and mounted concentric to said driven member and said driving member.

20. A method of limiting torque transfer between a driving member and a driven member comprising:

transmitting torque between a driving member and a driven member through a compressible friction coupling so that friction varies with compression of the coupling, and limiting compression of the coupling to selectively control torque transmission by said coupling member.

21. The method of claim 20 wherein the step of limiting compression of the coupling comprises limiting compression of the coupling to a predetermined maximum compression to limit torque transmission by said coupling to a predetermined maximum torque.

22. The method of claim 20 wherein the step of limiting compression of the coupling comprises limiting compression of the coupling to a predetermined maximum compression to set a predetermined coupling slip torque.

* * * * *